US005755415A

United States Patent [19]

Sorg

[11] Patent Number: 5,755,415

[45] Date of Patent: May 26, 1998

[54] RAZOR HOLDER

[76] Inventor: Fred M. Sorg, 204 Mt. Moriah Rd., Aurburn, Ga. 30203

[21] Appl. No.: 586,162

[22] Filed: Jan. 16, 1996

[51] Int. Cl.[6] ..... A47B 96/06

[52] U.S. Cl. ..... 248/213.2; 20/228; 248/682

[58] Field of Search ..... 248/682, 689, 248/213.2, 229.16, 229.26, 230.7, 311.2, 309.1, 316.7, 230.1; 30/41; 206/228; D6/526

[56] References Cited

U.S. PATENT DOCUMENTS

| | | | |
|---|---|---|---|
| D. 206,156 | 11/1966 | Schinker . | |
| D. 315,306 | 3/1991 | Reister | D9/434 |
| 2,532,244 | 11/1950 | Pashore | 248/311.2 X |
| 3,604,232 | 9/1971 | Mosher | 70/457 |
| 4,141,445 | 2/1979 | Korich | 206/228 |
| 4,232,785 | 11/1980 | Lucas | 206/228 |
| 4,320,832 | 3/1982 | Edstrom | 206/228 |
| 4,644,645 | 2/1987 | Audet | 30/41 |
| 4,646,999 | 3/1987 | Clark | 248/682 |
| 4,656,738 | 4/1987 | Corah | 30/41 |
| 4,695,029 | 9/1987 | Fox et al. | 248/360 |
| 4,823,445 | 4/1989 | Diener | 24/326 |
| 5,191,679 | 3/1993 | Harper | 248/311.2 X |

*Primary Examiner*—Ramon O. Ramirez

[57] ABSTRACT

The present invention relates to a razor holder for holding an razor to a cylindrical body, the present invention specifically designed for holding at least one razor next to the cylindrical body. The razor holder comprising, a circular holding member having at least one circular holding member semi-circular razor stem enclosure formed therein for holding the razor next to the cylindrical body. Advantageously, there will be a plurality of circular holding member semi-circular razor stem enclosures for holding multiple razors to the same cylindrical body. The present invention is also easy to manufacture and inexpensive.

11 Claims, 7 Drawing Sheets

RAZOR HOLDER

BACKGROUND OF THE INVENTION

1. Field of the Invention:

The present invention relates to a Razor Holder. More particularly, the present invention relates to holding the stem of the razor to a shaving can making it more convenient and accessible to a user.

2. Description of the Prior Art:

Generally, the razor and the shaving can are separate from each other this makes the use of the razor less convenient for the user, and makes it difficult at times to find both the razor and the shaving can together. The problem is further exasperated when there are more than one user for the same can of shaving cream.

Additionally, as anyone who must use a razor knows, not only is it difficult to find both the razor and the shaving cream together, the razor often finds itself behind the counter, the commode, or many of the places that the razor finds to become lost between uses. And the inability of the razor to be stored easily with the shaving can contributes to the clutter of the bathroom. Finally, marital or roommate discord often results when one party blames the other for the loss of a razor.

These experiences suggest that an invention that would enable an user to permanently store razors in a handy place would contribute greatly to the user's convenience. Thus an invention that would allow the razor and the shaving can to be stored together would be more convenient for the user, and one which allows the storage of several razors would find application in the marital bathroom, as well as the bathroom where roommates share the shaving cream.

Numerous innovations for a Razor Holder have been provided in the prior art that will be described as follows. However, even though these innovations may be suitable for the specific individual purposes to which they address, they differ from the present invention in that as hereinafter contrasted.

U.S. Pat. No. Des. 315,306, titled Shaving Razor Holding Device to Reister describes an ornamental design for a shaving razor holding device. The present invention differs from this invention because the present invention describes a holding device that can provide for more than one razor and that is one piece, thus, making the present invention easier to manufacture. Additionally the present invention is pre-tensioned allowing it to fit several different size cylindrical bodies, unlike the above described invention which can only fit one size cylindrical body.

U.S. Pat. No. 4,823,445, titled Razor Holding Means for Shaving Cream Cans to Diener comprises an improved clip device providing a releasable retention of an accessory object to a primary object. The storage clip comprises a shaped clasp member having a jaw portion for secure engagement of a mounting strap, a body portion adjacent to said jaw portion, a shoulder portion adjacent to said body portion, and terminates in a tab portion adjacent to said shoulder portion. The jaw, body, and shoulder portions are each configured to form an obtuse angle relative to its adjacent portion, and in the direction of said mounting strap, thereby defining a void or cavity between the clasp member and the mounting strap. The terminating tab portion preferably forms an angle relative to the adjacent shoulder portion and away from the mounting strap, providing a manually engageable surface for lifting the clasp member away from the mounting strap.

The present invention differs from the above described patented invention for the following reasons. One, it fails to meet the need for a simple device for holding razors onto a shaving can. Two, the above described patented invention is more difficult to manufacture, has many parts, and is too expensive to meet the need for a simple device for holding razors onto a shaving can. And, three, the above described invention does not provide a way to removably attach the holding device to the can so that it can be used more than one time.

U.S. Pat. No. 4,695,029 titled Support Device for Securing a Razor to a Shaving Cream Dispenser to Fox et al. comprises an adapter for securing a cosmetic implement to a cosmetic dispensing unit, such as a razor secured to a shaving can, which is made by positioning a snap-on supporting body or collar of unitary construction around the top of the dispensing unit. The collar includes a flange having a radial extension which defines an opening therethrough to receive the handle of the razor. The collar also includes a longitudinally extending ridge which receives the snap-on cap which comes with the shaving cream dispenser. Alternatively the ridge may be extended to form an integrally formed member to replace the cap which normally covers the can.

The present invention differs from the above described patented invention for the following reasons. One, the above described invention is again more complicated and difficult to manufacture than the present invention. Two, the above described invention requires more material, several rings of differing materials. And, three, the above described invention only provides for holding one razor, while the present invention provides for the storage of multiple razors. Finally the above described invention can only fit one size cylindrical body unlike the present invention which is pre-tensioned allowing it to fit several different size cylindrical bodies.

U.S. Pat. No. 4,656,738 titled, Razor Holding Means for Shaving Cream Cans, to Corah comprises how to provide one or more recesses in a shaving cream can for releasably engaging the head or handle, or both, of a safety razor for supporting the razor on the can. The recess or recesses may be provided in the lid of the can or in a band releasably attachable to a can when it is desired to discard the original lid.

The present invention differs from the above described patented invention for the following reasons. One, the above described invention is more complicated and difficult to manufacture than the present invention. Two, the above described invention has many parts related to the clip device; thus requiring more material to manufacture the above described invention, but the present invention is less expensive to manufacture having only one part. Three, the above described patented invention does not provide for a pre-tensioned holding device that can clamp more than one razor to the can.

U.S. Pat. No. 4,644,645 titled, Razor Holder, to Audet comprises a razor mountable on a can of shaving soap or other suitable surface, the purpose of which is to provide storage for the razor between uses. Various schemes to attach the razor to the can are disclosed, including resilient clips that can either lodge on, or snap fit about the rim on the can, and which are attached to the razor by adhesive, magnets, or are manufactured unitary with the razor. Alternatively the clips may have a cap that locks onto and grips the razor, or the razor may be provided only with magnets, which directly attach the razor to, e.g., the metal can or any metallic surface. As a further alternative, the clips may have tubes or rings, into which a razor can be inserted and permanently stored.

The present invention differs from the above described patented invention for the following reasons. One, the present invention provides for a removably attachable device that can attach to a cylindrical body, thus allowing any size razor to fit with little effort by the user. Two, the above described invention is more complicated than the present invention, making it more difficult to manufacture. And, three, the above described invention does not provide a way to removably attach the razor to the shaving can so that it can not be shaken loose, unlike the present invention which provides a device for removable yet durable attachment to the cylindrical body.

U.S. Pat. No. 3,604,232 titled, Elastic Keyring, to Mosher comprises a keyring having a body in the form of a wide, flat, continuous loop of cloth-covered elastic material which is circumferentially stretchable, with individual elastic key attachment loops on the outside of the body loop which are adapted to circumferentially stretch along with the body. The keyring is generally soft and flexible for easy and comfortable carrying in purse or pocket, and is circumferentially stretchable for engagement over the hand and attachment about the wrist for convenient and comfortable carrying during activities.

The present invention differs from the above described patented invention for the following reasons. One, the present invention is not made of soft and flexible material. Two, the present invention has enclosures which are built into the device rather then be in separate pieces sown onto a ring. Three, the present invention is made to removably attachable by pressure or tension, unlike the above described invention which is removably attachable through the use of key rings. And, four, the present invention does not completely encompass the cylindrical body, unlike the above described invention which encompasses the cylindrical body.

U.S. Pat. Des. 206,156 titled, Razor Holder to Schinker describes an ornamental razor holder. The present invention differs from the above described patented invention for the following reasons. One, the present invention allows for the attachment of several razors, unlike the above described invention which only allows for one razor. Two, the above described invention does not provide for easy removal and attachment to the cylindrical body like the present inventions does. Finally, the above described invention does not allow for the installation of the holding device on more than one size can, unlike the present invention which is pre-tensioned to allow it to fit on more than one size can.

Numerous innovations for a Razor Holder have been provided in the prior art that are adapted to be used. Even though these innovations may be suitable for the specific individual purposes to which they address, they would not be suitable for the purposes of the present invention as heretofore described.

SUMMARY OF THE INVENTION

The Razor Holder was invented to enable a user to attach the razor to a can of shaving cream. This enables the user to always have the razor or razors ready and available for use no matter where the user puts the can of shaving cream. The razor or razors clamp onto the side of the can by a circular holding member that is pre-tensioned.

Another method would be to attach the Razor Holder to the can of shaving cream at the factory and sell the cans with at least two disposable razors attached to the can. The reason for multiple enclosures is to allow the man to use one and the woman to use the other. This is oftentimes a source of disputes because one will use the other's blade and forget where he or she left the razor.

By using the Razor Holder the razor will always be where the can of shaving cream is located. When the razor is ready to be replaced, simply attach a new one in its place.

Accordingly, it is an object of the present invention to provide a devices for attaching accessory items to a cylindrical body.

More particularly, it is an object of the present invention to provide to provide for an inexpensive device for attaching multiple razors to a cylindrical body.

In keeping with these objects, and with others which will become apparent hereinafter, one feature of the present invention resides, briefly stated, is that the present invention provides a device for attaching accessory items to a cylindrical body that is simple to manufacture.

Another feature of the present invention is that the present invention provides a device for attaching accessory items to a cylindrical body that can be used with several different cylindrical bodies thus enhancing its life and utility.

Yet another feature of the present invention is that the present invention provides a support device for attaching more than one razor to a cylindrical body, thus allowing the use of the cylindrical body by more than one person.

Still another feature of the present invention is that the present invention provides a support device for attaching accessory items to a cylindrical body that can be made individually and in combination of metal, metal alloy, plastic, plastic composite, rubber, rubber composite or similar material that can be pre-tensioned to hold the support device and the accessory item to the cylindrical body.

Yet still another feature of the present invention is that the present invention provides a support device for attaching a razor to a cylindrical body so that the razor will always be ready and present with the cylindrical body.

Still yet another feature of the present invention is that the circular holding member cylindrical body have different widths, being narrower at the enclosures for easier lifting, removal and tensioning.

And another feature of the present invention is that the circular holding member tail cylindrical body be positioned away (curved away) from the circular body for easier insertion over the circular body.

Yet another feature of the present invention is that the circular holding member tail cylindrical body be positioned away from the circular body for easier insertion of the stem of the razor for clasping it against the circular body.

And finally, another feature of the present invention is that the present invention could easily be attached to cylindrical bodies at the factory thus providing the user with a more convenience.

BRIEF DESCRIPTION OF THE PREFERRED EMBODIMENT

Figure 4:
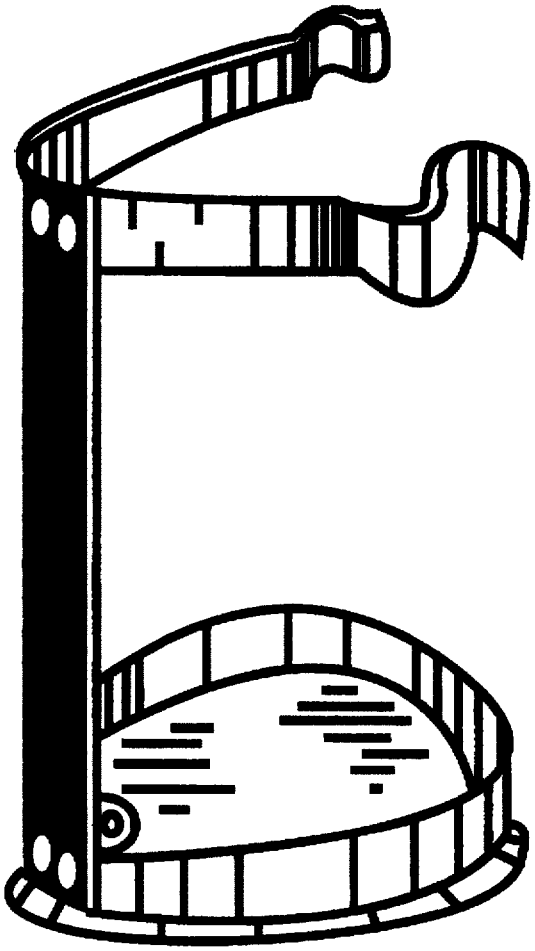

FIG. 4 a perspective view of a fourth embodiment showing a folding bottom rotatably fastened to a riser member on one distal end. The opposite distal end of the riser member is rotatably fastened to the preferred embodiment.

Figure 5:
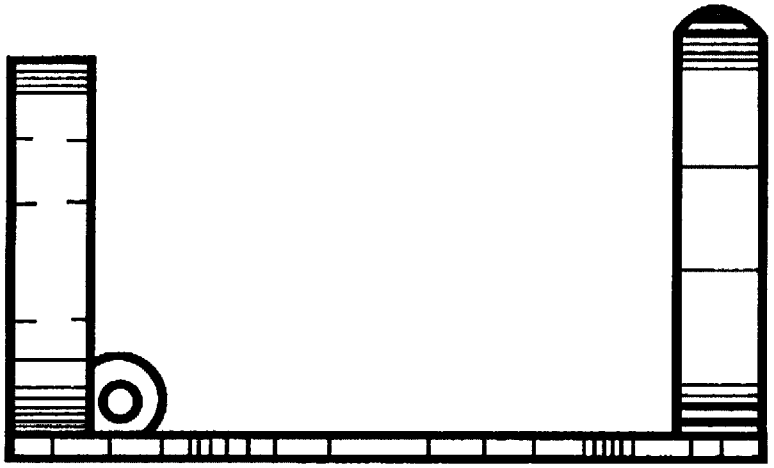

FIG. 5 is a left side view of a fourth embodiment in a open position showing a folding bottom rotatably fastened to a riser member on one distal end. The opposite distal end of the riser member is rotatably fastened to the preferred embodiment.

Figure 6:
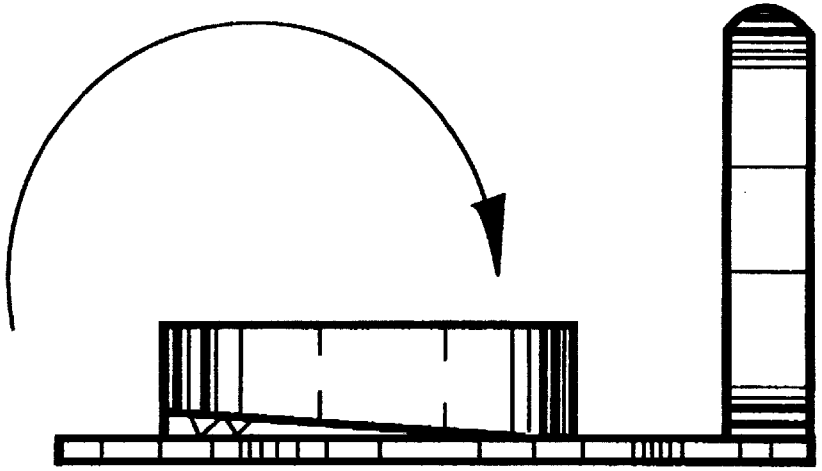

FIG. 6 is a side view of a fourth embodiment in a closed position showing a folding bottom rotatably fastened to a riser member on one distal end. The opposite distal end of the riser member is rotatably fastened to the preferred embodiment.

DETAILED DESCRIPTION OF THE PREFERRED EMBODIMENT

Firstly, referring to FIG. (1A), which shows a side view of the preferred embodiment showing the first razor holder (10) attached to the first cylindrical body (14) and holding one first razor (16), exhibiting the following features: first razor holder (10), first circular holding member (12), first circular holding member razor stem enclosure A (12A), first circular holding member razor stem enclosure tail (12AA), first circular holding member razor stem enclosure B (12B), first circular holding member razor stem enclosure C (12C), first circular holding member end tail (12D), first cylindrical body (14), first cylindrical body head (14A), first razor (16), first razor stem (16A), first razor stem thin member (16AA), first razor stem thick member (16AB), and first razor head (16B).

The first razor holder (10) is shown circling a first cylindrical body (14) with a single first razor (16) held into place. The first circular holding member (12) is held onto the first cylindrical body (14) by being pre-tensioned to fit around the diameter of the first cylindrical body (14). The first circular holding member (12) has two ends and does not complete enclose the cylindrical body. The incomplete closure and the tensioning is designed such that it will allow the first circular holding member (12) to fit cylindrical bodies (14) of different diameters. The first circular holding member (12) has a first circular holding member razor stem enclosure A (12A) for holding a first razor (16). The first circular holding member (12) further has a first circular holding member end tail (12D) which releases the tension holding the first circular holding member (12) to the first cylindrical body (14). The first razor (16) having a first razor head (16B) is held into place in the first circular holding member razor stem enclosure A (12A) by the shape of the first razor stem (16A) which includes a first razor stem thin member (16AA) and a first razor stem thick member (16AB). The razors (16) are inserted from the bottom up using the first circular holding member razor stem enclosure tail (12AA) or the first circular holding member end tail (12D) to slightly release the tension of the circular holding member, and sliding the first razor stem thick member (16AB) past the first circular holding member razor stem enclosure A (12A) toward the first cylindrical body head (14A) until the first razor stem thick member (16AB) is aligned in the first circular holding member razor stem enclosure A (12A). The first circular holding member razor stem enclosure tail (12AA) is then released.

The first circular holding member razor stem enclosures (12A,12B, or 12C) may be narrower in diameter than the first razor stem thin member (16AA) so that it is securely held. The first circular holding member razor stem enclosure tail (12AA) and the first circular holding member end tail (12D) are formed extending out from the first cylindrical body (14).

Continuing by referring to FIG. (1B), which shows a top view of the preferred embodiment showing the first razor holder (10) attached to the first cylindrical body (14) and holding two first razors (16), exhibiting the following features: first razor holder (10), first circular holding member (12), first circular holding member razor stem enclosure A (12A), first circular holding member razor stem enclosure B (12B), first circular holding member razor stem enclosure C (12C), first circular holding member end tail (12D), first cylindrical body (14), first cylindrical body head (14A), first razor (16), first razor stem (16A) and first razor stem (16AA).

The first razor holder (10) is shown completely around the first cylindrical body (14). The first circular holding member (12) has three semi-circular razor stem enclosures: the first circular holding member razor stem enclosure A (12A), a first circular holding member razor stem enclosure B (12B), and a first circular holding member razor stem enclosure C (12C). The first circular holding member razor stem enclosure A (12A), and the first circular holding member razor stem enclosure B (12B) are shown holding two first razors (16) into place. The first circular holding member razor stem enclosure C (12C) is shown without a first razor (16). The first circular holding member end tail (12D) is alternatively used to release the tension of the first circular holding member (12) while inserting the first razor stem (16A) into one of the first circular holding member razor stem enclosures (12A,12B, or 12C).

The first circular holding member (12) is manufactured from a group of materials consisting of plastic, plastic composite, rubber, rubber composite, metal and metal alloy.

Figure 1A:
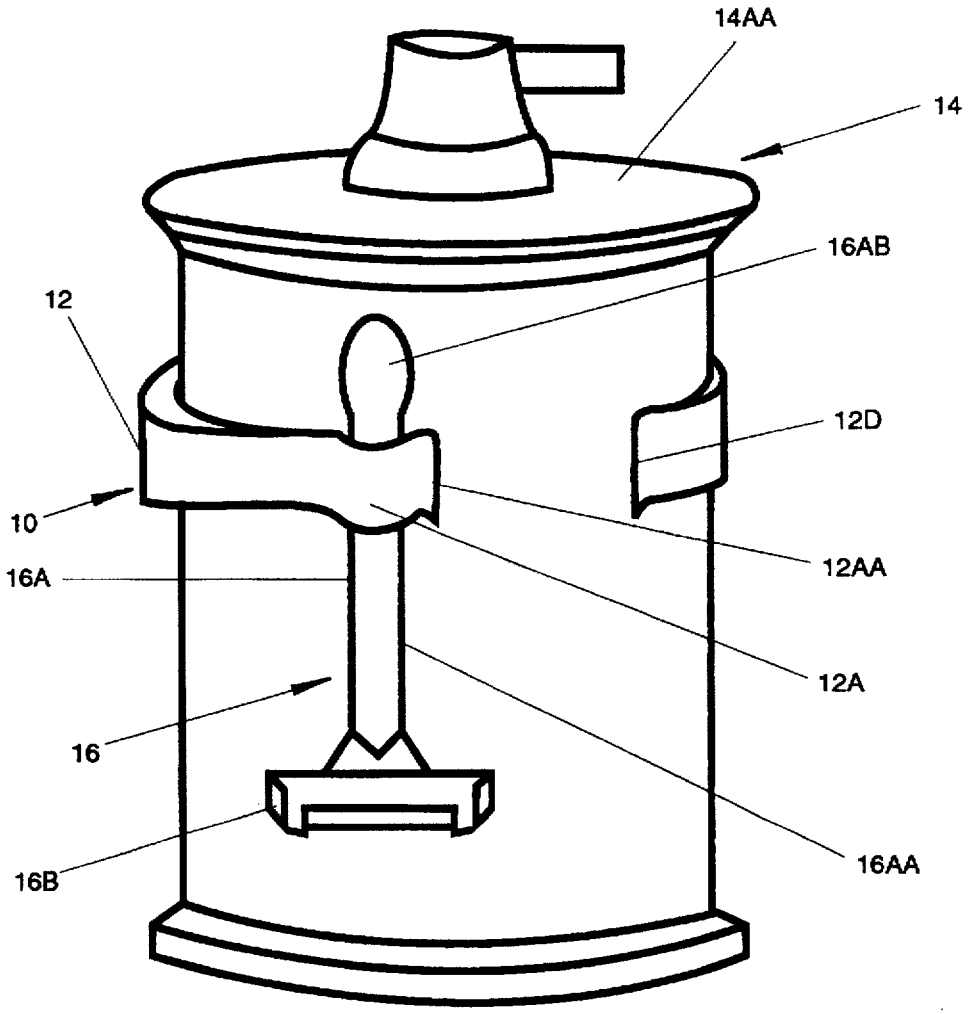
FIG. 1A is a side view of the preferred embodiment showing the razor holder holding one razor by a razor stem portion.
Figure 1B:
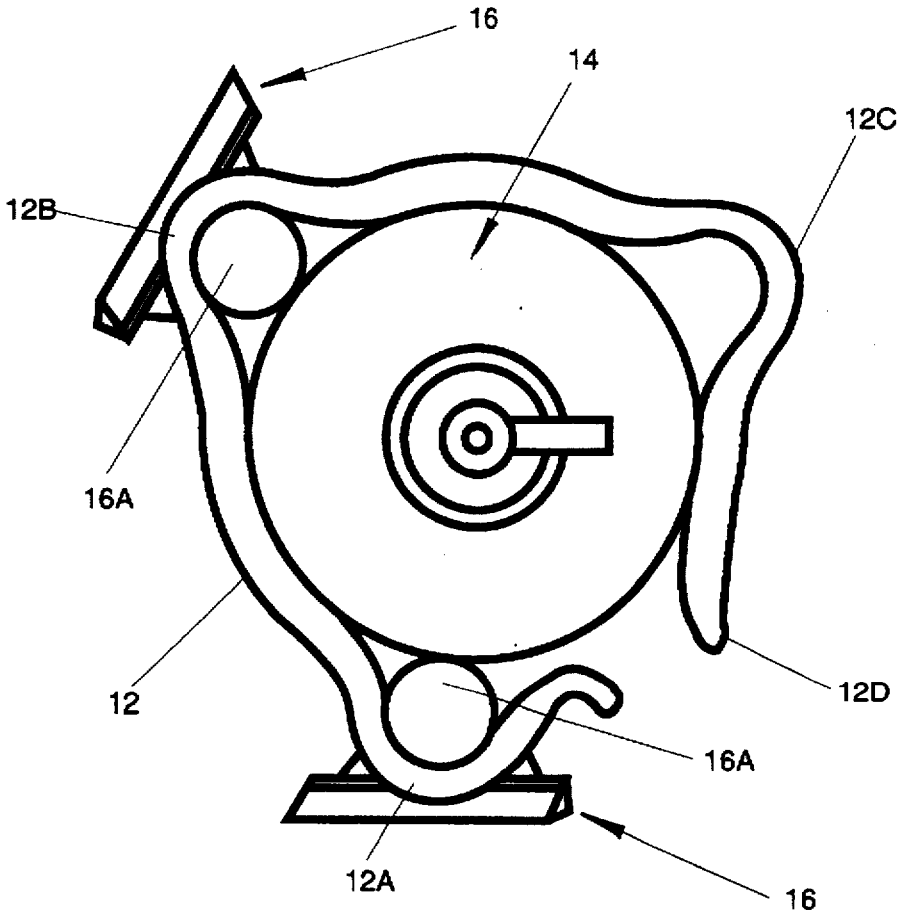
FIG. 1B is a top view of the preferred embodiment showing the razor holder attached to the cylindrical body and holding two razors by a razor stem portion.
Figure 2:
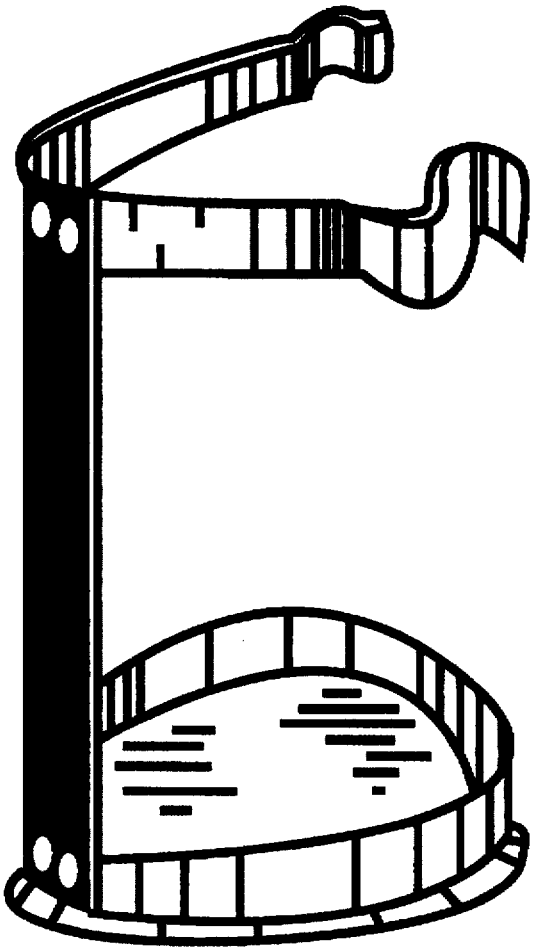
FIG. 2 is a perspective view of a second embodiment showing a bottom riveted to the preferred embodiment at opposite distal ends of a riser member.

Now referring to FIG. 2 which is a perspective view of a second razor holder (110) having a second circular holding member (112) and a second bottom (112I) riveted at opposite distal ends of a second riser (112E) exhibiting the following features: second razor holder (110), second circular holding member (112), second circular holding member razor stem enclosure A (112A), second circular holding member razor stem enclosure tail (112AA), second circular holding member razor stem enclosure C (112C), second circular holding member end tail (112D), second riser (112E), second riser rivet A (112F1), second riser rivet B (112F2), second riser rivet C (112F3), second riser rivet D (112F4), second bottom bead (112G), second cylindrical rim (112H) and second bottom (112I).

A second razor holder (110) having a second circular holding member (112) which is securely attached to a second circular holding member razor stem enclosure A (112A). The second circular holding member razor stem enclosure A (112A) is securely attached to a second circular holding member razor stem enclosure tail (112AA) on one distal end. The second circular holding member (112) further has a second circular holding member razor stem enclosure C (112C) securely attached to a second circular holding member end tail (112D) on the opposite distal end.

The second circular holding member (112) is securely fastened to the upper distal end of a second riser (112E) by at least one of a pair of riser rivets second riser rivet A (112F1) and a second riser rivet B (112F2). The lower distal end of the second riser (112E) is similarly securely attached to a second cylindrical rim (112H) by a second riser rivet C (112F3) and a second riser rivet D (112F4). The second cylindrical rim (112H) is securely attached at a lower circumference to a second bottom (112I) by a second bottom bead (112G). The second razor holder (110) is manufactured from a group of materials consisting of plastic, plastic composite, rubber, rubber composite, metal and metal alloy.

Figure 3:
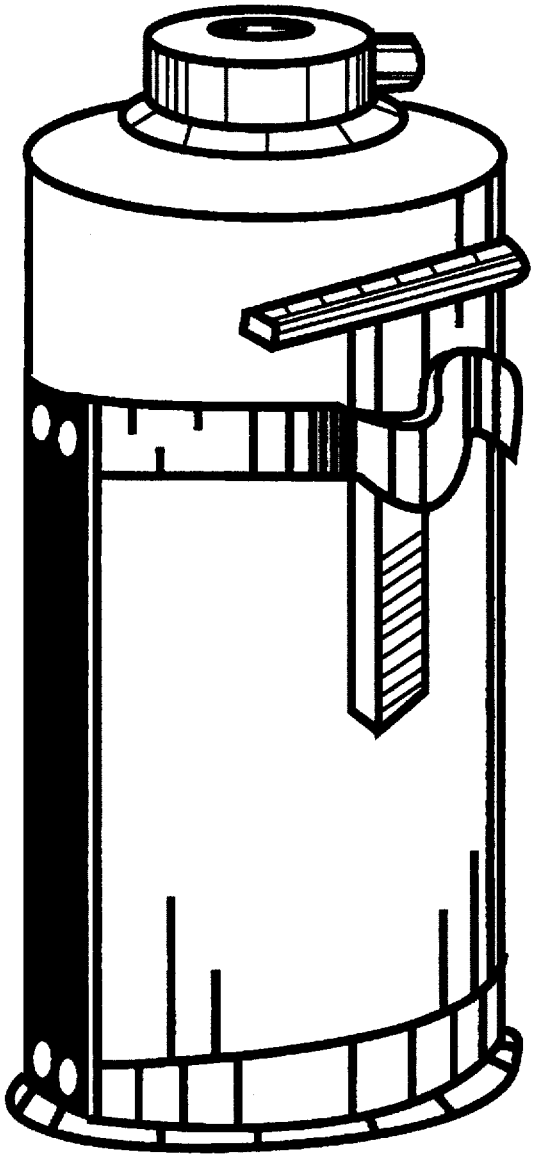
FIG. 3 is a perspective view of a third embodiment showing a bottom slide clipped to the preferred embodiment at opposite distal ends of a riser member.

Now referring to FIG. 3 which is a perspective view of a third razor holder (210) having a third circular holding member (212) and a third cylindrical rim (212I) slidably attached at opposite distal ends of a third riser (212E) exhibiting the following features: third circular holding member (212), third circular holding member razor stem enclosure A (212A), third circular holding member razor stem enclosure tail (212AA), third riser (212E), third upper receptacle (212G), third lower receptacle (212H), third cylindrical rim (212I), third bottom bead (212J), third cylindrical body (214), third cylindrical body head (214A), third razor (216), third razor stem (216A), and third razor head (216B).

The third circular holding member (212) is shown circling a third cylindrical body (214) with a single third razor (216) held into place. The third circular holding member (212) is held onto the third cylindrical body (214) by being pre-tensioned to fit around the diameter of the third cylindrical body (214). The third circular holding member (212) has two ends and does not complete enclose the cylindrical body. The incomplete closure and the tensioning is designed such that it will allow the third circular holding member (212) to fit cylindrical bodies (214) of different diameters. The third circular holding member (212) has a third circular holding member razor stem enclosure A (212A) for holding a third razor (216). The third razor head (216B) is securely attached to a the third razor stem (216A). The third razor (216) is held into place in the third circular holding member razor stem enclosure A (212A) by the shape of the third razor stem (216A). The razors (216) are inserted from the bottom up using the third circular holding member razor stem enclosure tail (212AA) to slightly release the tension of the circular holding member, and sliding the third razor stem (216A) past the third circular holding member razor stem enclosure A (212A) toward the third cylindrical body head (214A) until the third razor stem (216A) is aligned in the third circular holding member razor stem enclosure A (212A). The third circular holding member razor stem enclosure tail (212AA) is then released.

The third circular holding member razor stem enclosures A (212A) may be narrower in diameter than the third razor stem (216A) so that it is securely held. The third circular holding member razor stem enclosure tail (212AA) is formed extending out from the third cylindrical body (214).

The third circular holding member (212) having a third circular holding member razor stem enclosure A (212A) securely attached to a third circular holding member razor stem enclosure tail (212AA) on one distal end. The third circular holding member (212) is slidably fastened to the upper distal end of a third riser (212E). The lower distal end of the third riser (212E) is slidably fastened to a third lower receptacle (212H). The third lower receptacle (212H) is securely fastened to a third cylindrical rim (212I) which is securely attached at a lower circumference to a third bottom bead (212J).

Referring now to FIG. 4 which is a perspective view of a fourth razor holder (310) comprising a fourth circular holding member (312) rotatably fastened to a fourth riser (312E) member on a upper distal end. The lower distal end of fourth riser (312E) member is rotatably fastened to a fourth cylindrical rim (312J) exhibiting the following features: fourth circular holding member (312), fourth circular holding member first semi-circular razor stem enclosure (312A), fourth circular holding member first semi-circular razor stem enclosure tail (312AA), fourth circular holding member second semi-circular razor stem enclosure (312C), fourth circular holding member end tail (312D), fourth riser (312E), fourth hinge pin (312F), fourth upper riser hinge (312G), fourth lower riser hinge (312H), fourth lower riser (312I), fourth cylindrical rim (312J), fourth bottom (312K), and fourth upper riser (312N).

A fourth razor holder (310) having a fourth circular holding member (312) which is securely attached to a fourth circular holding member razor stem enclosure A (312A). The fourth circular holding member razor stem enclosure A (312A) is securely attached to a fourth circular holding member razor stem enclosure tail (312AA) on one distal end. The fourth circular holding member (312) further has a fourth circular holding member razor stem enclosure C (312C) securely attached to a fourth circular holding member end tail (312D) on the opposite distal end.

The fourth circular holding member (312) is fastened securely to one distal end of a fourth upper riser (312N). The opposite distal end of the fourth upper riser (312N) is securely fastened to a fourth upper riser hinge (312G). The fourth upper riser hinge (312G) is rotatably fastened about a fourth hinge pin (312F) to the upper distal end of the fourth riser (312E). The lower distal end of the fourth riser (312E) is rotatably fastened about a fourth hinge pin (312F) to fourth lower riser hinge (312H), which is securely fastened to a fourth lower riser (312I). The fourth lower riser (312I) is securely fastened to a fourth cylindrical rim (312J), which is fastened securely at a lower circumference to a fourth bottom (312K).

Now referring to FIG. 5 which is a left side view of a fourth embodiment in a open position showing exhibiting the following features: fourth circular holding member 312, fourth hinge pin (312F), fourth upper riser hinge (312G), fourth lower riser hinge (312H), fourth cylindrical rim (312J), fourth lower opening/closing direction (312M), and fourth upper opening/closing direction (312O).

The fourth circular holding member (312) is rotated about the fourth hinge pin (312F) along a fourth upper opening/closing direction (312O) until the fourth circular holding member (312) lies flat along a fourth riser (312E). A fourth cylindrical rim (312J) is similarly folded about a fourth lower riser hinge (312H) along a fourth lower opening/closing direction (312M) until the fourth cylindrical rim (312J) lies flat along the fourth riser (312E).

Referring to FIG. 6 which is a side view of a fourth embodiment in a collapsed position exhibiting the following features: fourth circular holding member (312), fourth riser (312E), fourth hinge pin (312F), fourth upper riser hinge (312G), fourth lower riser hinge (312H), fourth cylindrical rim (312J), fourth lower opening/closing direction (312M) and fourth upper opening/closing direction (312O).

The fourth cylindrical rim (312J) is collapsed by a clockwise rotation toward the fourth riser (312E) about a fourth hinge pin (312F) along a fourth lower opening/closing direction (312M). The fourth circular holding member 312 is collapsed by a counter clockwise rotation toward the fourth riser (312E) about a fourth hinge pin (312F) along a fourth upper opening/closing direction (312O).

It will be understood that each of the elements described above, or two or more together, may also find a useful application in other types of constructions differing from the type described above.

While the invention has been illustrated and described as embodied in the figures above it is not intended to be limited to the details shown, since it will be understood that various omissions, modifications, substitutions and changes in the forms and details of the device illustrated and in its operation cylindrical body be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

I Claim:

1. A razor holder (110) functioning to hold a cylindrical body therein and hold a razor onto the cylindrical body, the razor holder (110) comprising:

A) a circular holding member (112) which comprises a circular holding member razor stem enclosure tail (112AA) and a circular holding member end tail (112D), the circular holding member (112) further comprises at least one circular holding member razor stem enclosure (112A) positioned between the circular holding member razor stem enclosure tail (112AA) and the circular holding member end tail (112D);

B) a riser (112E) securely affixed at a top distal end by a permanent fastening means to the circular holding member (112); and C) a cylindrical rim (112H) securely affixed by a permanent fastening means to at a bottom distal end of the riser (112E), the cylindrical rim (112H) is fastened to a bottom (112I) by a bottom bead (112G).

2. The razor holder (110) as described in claim 1 wherein the permenant fastening means is at least one pair of riser rivets at the top distal end of the riser (112E) and at least one pair of riser rivets at the bottom distal end of the riser (112E).

3. The razor holder (110) as described in claim 1, wherein the circular holding member semi-circular razor stem enclosure tail (12AA) is curved in an outward direction functioning to facilitate placement on and removal therefrom of the circular holding member (112) onto the cylindrical body (14).

4. The razor holder (110) as described in claim 1, wherein the razor holder (110) is manufactured from a material selected from a group consisting of plastic, plastic composite, rubber, rubber composite, metal and metal alloy.

5. A razor holder (210) functioning to hold a cylindrical body (214) therein and hold a razor (216) onto the cylindrical body (214), the circular holding member (212) comprising:

A) a circular holding member (212) which comprises two circular holding member razor stem enclosure tails (212AA) one circular holding member razor stem enclosure tail (212AA) positioned at a distal end and the other circular holding member razor stem enclosure tails (212AA) positioned at an opposite distal end, the circular holding member (212) further comprises at least one circular holding member razor stem enclosure A (212A) positioned between the two circular holding member razor stem enclosure tails (212AA), the circular holding member (212) further comprises a upper receptacle (212G) securely attached thereto;

B) a riser (212E) removably fastened at a top distal end within the upper receptacle (212G) of the circular holding member (212); and C) a cylindrical rim (212I) is fastened to a lower bottom by a bottom bead (212J), the cylindrical rim (212I) further comprises a lower receptacle (212H) attached thereto, the riser (212E) is removably fastened at a bottom distal end within the lower receptacle (212H).

6. The razor holder (210) as described in claim 5, wherein the circular holding member semi-circular razor stem enclosure tail (212AA) is curved in an outward direction functioning to facilitate placement on and removal therefrom of the circular holding member (212) onto the cylindrical body (214).

7. The razor holder (210) as described in claim 5, wherein the razor holder (210) is manufactured from a material selected from a group consisting of plastic, plastic composite, rubber, rubber composite, metal and metal alloy.

8. A razor holder (310) functioning to hold a cylindrical body therein and to hold a razor onto the cylindrical body, the razor holder (310) comprising:

A) a circular holding member (312) which comprises a circular holding member razor stem enclosure tail (312AA) positioned at a distal end and a circular holding member end tail (312D) positioned an opposite distal end, the circular holding member (312) further comprises at least one circular holding member razor stem enclosure A (312A) positioned between the circular holding member razor stem enclosure tail (312AA) and the circular holding member end tail (312D);

B) a upper riser (312N) securely affixed at a top distal end by a permenant fastening means to the circular holding member (312), the upper riser (312N) further comprises a upper riser hinge (312G) positioned at a lower distal end;

C) a cylindrical rim (312J) securely affixed by a permenant fastening means at a lower distal end to a lower riser (312I), the lower riser (312I) further comprises a lower riser hinge (312H) at an upper distal end, the cylindrical rim (312J) is securely fastened to a bottom (312K); and D) a riser (312E) hingably affixed at a top distal end to the upper riser hinge (312G) by a hinge pin (312F), the riser (312E) hingably affixed at a lower distal end to the lower riser hinge (312H) by a hinge pin (312F).

9. The razor holder (310) as described in claim 8, wherein the circular holding member semi-circular razor stem enclosure tail (312AA) is curved in an outward direction functioning to facilitate placement on and removal therefrom of the circular holding member (312) onto the cylindrical body (314).

10. The razor holder (310) as described in claim 8, wherein the circular holding member end tail (312D) is curved in an outward direction functioning to facilitate placement on and removal therefrom of the circular holding member (312) onto the cylindrical body (314).

11. The razor holder (310) as described in claim 8, wherein the circular holding member (312) is manufactured from a material selected from a group consisting of plastic, plastic composite, rubber, rubber composite, metal and metal alloy.

* * * * *